US010246998B2

(12) United States Patent
Milh et al.

(10) Patent No.: US 10,246,998 B2
(45) Date of Patent: Apr. 2, 2019

(54) SYSTEMS AND METHODS FOR AN EXPANDABLE PACKER

(71) Applicant: Schlumberger Technology Corporation, Sugar Land, TX (US)

(72) Inventors: Patrice Milh, Abbeville (FR); Pierre-Yves Corre, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 219 days.

(21) Appl. No.: 15/278,057

(22) Filed: Sep. 28, 2016

(65) Prior Publication Data

US 2017/0089167 A1 Mar. 30, 2017

(30) Foreign Application Priority Data

Sep. 30, 2015 (EP) ..... 15290250

(51) Int. Cl.
*E21B 49/10* (2006.01)

(52) U.S. Cl.
CPC ..... *E21B 49/10* (2013.01)

(58) Field of Classification Search
CPC ..... E21B 33/1277; E21B 49/10
See application file for complete search history.

(56) References Cited

U.S. PATENT DOCUMENTS 2,581,070 A * 1/1952 Blood ..... E21B 33/127 166/100
2,600,173 A * 6/1952 Sewell ..... E21B 33/127 166/100
2,675,080 A * 4/1954 Williams ..... E21B 33/1246 166/100
2,742,968 A * 4/1956 Hildebrandt ..... E21B 33/1243 166/100
2,843,208 A * 7/1958 Blood ..... E21B 33/1243 166/100
3,602,009 A * 8/1971 Powell ..... F16C 1/08 285/319
4,073,186 A * 2/1978 Erwin, Jr. ..... G01F 9/001 73/114.42
6,112,726 A * 9/2000 Saito ..... F02B 61/045 123/195 P
7,699,124 B2 4/2010 Corre et al.
2009/0301635 A1* 12/2009 Corre ..... B29C 35/0227 156/84
2014/0008061 A1* 1/2014 Corre ..... E21B 33/1208 166/264
2014/0020890 A1 1/2014 Corre et al.

* cited by examiner

*Primary Examiner* — Shane Bomar
(74) *Attorney, Agent, or Firm* — Michael Dae

(57) ABSTRACT

The present disclosure relates to a downhole packer assembly that includes an outer skin, an inner packer disposed within the outer skin such that inflation of the inner packer is configured to expand the outer skin, and a flexible flowline at least partially embedded within the outer skin. The flexible flowline is configured to flex as the outer skin expands.

14 Claims, 4 Drawing Sheets

SYSTEMS AND METHODS FOR AN EXPANDABLE PACKER

CROSS REFERENCE TO RELATED APPLICATIONS

This application claims the benefit of European Application No. 15290250.8 filed on Sep. 30, 2015, incorporated by reference herein in its entirety.

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a downhole packer assembly that includes an outer skin, an inner packer disposed within the outer skin such that inflation of the inner packer is configured to expand the outer skin, and a flexible flowline at least partially embedded within the outer skin. The flexible flowline is configured to flex as the outer skin expands.

The present disclosure also relates to a sealing element for a downhole packer assembly that includes a cylinder comprising an elastomeric material, a flexible flowline at least partially embedded within the cylinder along an axial direction of the cylinder, and a drain disposed in the cylinder. The flexible flowline is configured to flex at least partially in a radial direction of the sealing element as the cylinder expands.

The present disclosure also relates to a method that includes providing a packer assembly having an inner packer disposed within an outer skin and a flexible flowline at least partially embedded within the outer skin, positioning the packer assembly in a wellbore, inflating the inner packer until the outer skin seals against a wall of the wellbore, and flexing the flexible flowline as the inner packer inflates.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
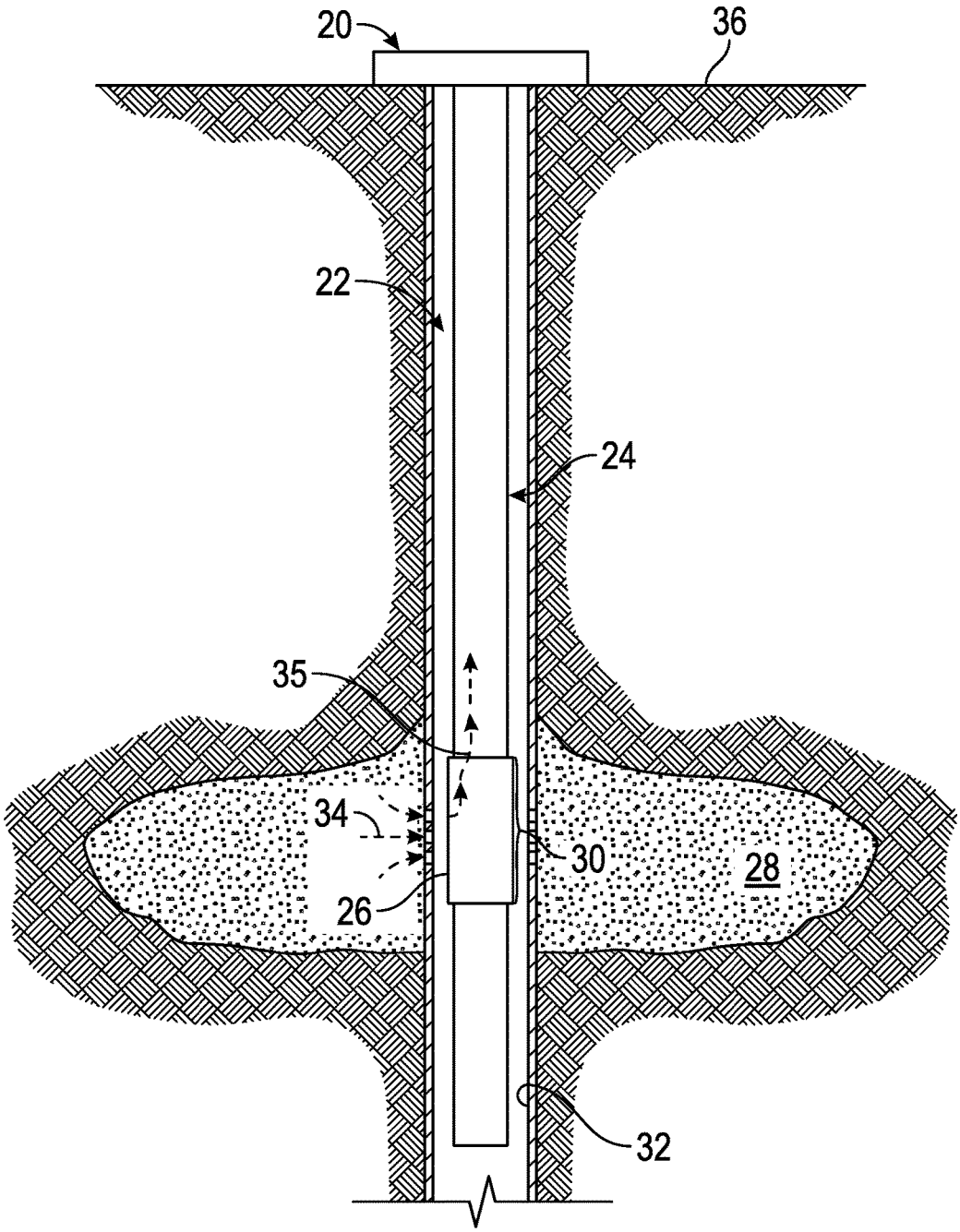
FIG. 1 is a schematic front elevation view of an embodiment of a well system having a packer assembly through which formation fluids may be collected, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for an expandable packer, such as an expandable packer assembly used as part of a downhole tool disposed in a wellbore. In certain embodiments, formation fluid samples are collected through an outer layer of the packer assembly and conveyed to a desired collection location. In addition, the packer assembly may include an expandable sealing element that enables the packer assembly to better support the formation in a produced zone at which formation fluids are collected. In certain embodiments, the packer assembly expands across an expansion zone, and formation fluids can be collected from the middle of the expansion zone, i.e. between axial ends of the outer sealing layer. The formation fluid collected is directed along flowlines, e.g. along flow tubes, having sufficient inner diameter to allow operations in a variety of environments. Formation fluid can be collected through one or more drains. For example, separate drains can be disposed along the length of the packer assembly to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

In certain embodiments, the packer assembly includes several components or layers, such as an outer skin and an inner packer disposed within the outer skin such that inflation of the inner packer causes the outer skin to expand. The flowlines may be partially or completely embedded within the outer skin. In addition, the flowlines may be flexible such that the flowline flexes as the outer skin expands. In various embodiments, the flowline may be made from a flexible material and/or include particular structural features to enable the flowline to flex. The use of the disclosed embodiments of the packer assembly with flexible flowlines may improve the performance of the packer assembly when the walls of the wellbore are not smooth or straight. Packer assemblies with flexible flowlines may be more capable of conforming to any irregularities of the wellbore walls, thereby improving the seal between the wall and packer assembly. Improved sealing may increase the sampling efficiency, reduce sample contamination, help maintain sufficient differential pressure for drawdown, and so forth.

Referring generally to FIG. 1, one embodiment of a well system 20 is illustrated as deployed in a wellbore 22. The well system 20 includes a conveyance 24 employed to deliver at least one packer assembly 26 downhole. In many applications, the packer assembly 26 is deployed by conveyance 24 in the form of a wireline, but conveyance 24 may have other forms, including tubing strings, for other applications. In the illustrated embodiment, the packer assembly 26 is used to collect formation fluids from a surrounding formation 28. The packer assembly 26 is selectively expanded in a radially outward direction to seal across an expansion zone 30 with a surrounding wellbore wall 32, such as a surrounding casing or open wellbore wall. When the packer assembly 26 is expanded to seal against wellbore wall 32, formation fluids can be flowed into the packer assembly 26, as indicated by arrows 34. The formation fluids are then directed to a flowline, as represented by arrows 35, and produced to a collection location, such as a location at a well site surface 36. As described in detail below, the packer assembly 26 may include one or more flexible flowlines, thereby increasing compliance of the packer assembly 26 with the wellbore wall 32.

Figure 2:
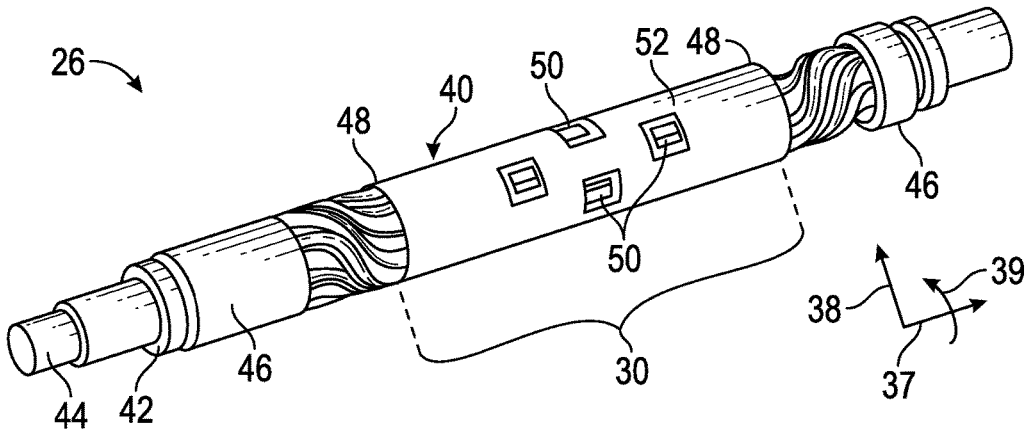
FIG. 2 is an orthogonal view of one example of the packer assembly illustrated in FIG. 1, according to an embodiment of the present disclosure.

Referring generally to FIG. 2, one embodiment of the packer assembly 26 is illustrated, which may have an axial axis or direction 37, a radial axis or direction 38, and a circumferential axis or direction 39. In this embodiment, packer assembly 26 includes an outer layer 40 (e.g., outer skin) that is expandable in the wellbore 22 to form a seal with surrounding wellbore wall 32 across expansion zone 30. The packer assembly 26 further includes an inner, inflatable bladder 42 disposed within an interior of outer layer 40. In one example, the inner bladder 42 (e.g., inner packer) is selectively expanded by fluid delivered via an inner mandrel 44. Furthermore, packer assembly 26 includes a pair of mechanical fittings 46 that are mounted around inner mandrel 44 and engaged with axial ends 48 of outer layer 40.

Figure 3:
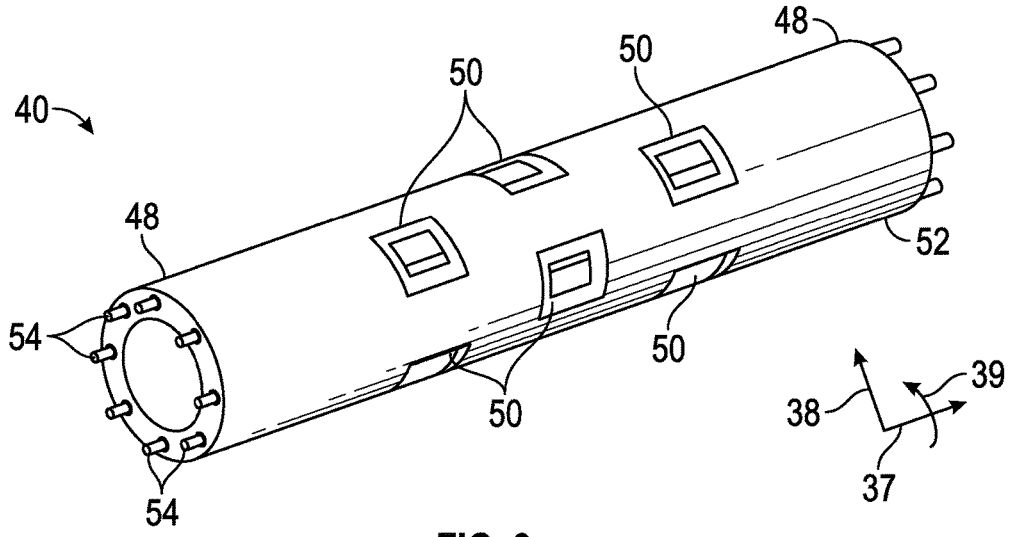
FIG. 3 is an orthogonal view of one example of an outer layer that can be used with the packer assembly, according to an embodiment of the present disclosure.
Figure 4:
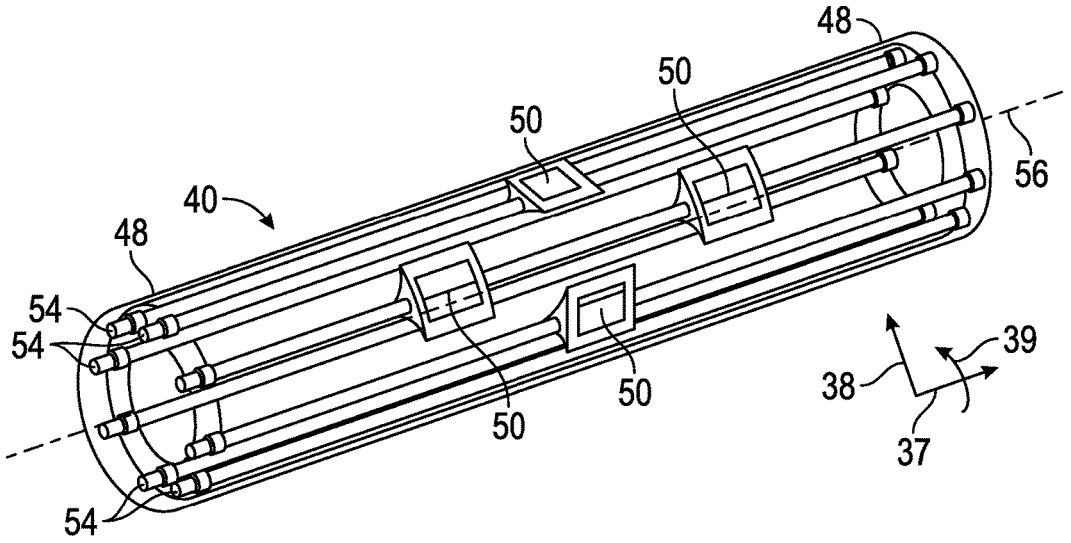
FIG. 4 is a view similar to that of FIG. 3 but showing internal components of the outer layer, according to an embodiment of the present disclosure.

With additional reference to FIG. 3, outer layer 40 may include one or more windows or drains 50 through which formation fluid is collected when outer layer 40 is expanded against surrounding wellbore wall 32. Drains 50 may be embedded radially into a sealing element 52 of outer layer 40. By way of example, sealing element 52 may be cylindrical and formed of an elastomeric material selected for hydrocarbon based applications, such as nitrile rubber (NBR), hydrogenated nitrile butadiene rubber (HNBR), and fluorocarbon rubber (FKM). A plurality of flexible tubular members, tubes, or flowlines 54 may be operatively coupled with drains 50 for directing the collected formation fluid in an axial 37 direction to one or both of the mechanical fittings 46. In one example, alternating flexible flowlines 54 are connected either to an individual central drain or to two drains located equidistant from an axial center region of the outer layer 40, respectively. As further illustrated in FIG. 4, flexible flowlines 54 may be aligned generally parallel with a packer axis 56 that extends through the axial ends of outer layer 40. In the illustrated example, the flexible flowlines 54 are at least partially embedded in the material of sealing element 52 and thus move radially 38 outward and radially 38 inward during expansion and contraction of outer layer 40. Further, as described in detail below, embodiments of the flexible flowlines 54 flex or bend as the outer layer 40 expands and contracts. In certain embodiments, the flexible flowlines 54 are made from a flexible material, such as an elastomeric material. Additionally or alternatively, the flexible flowlines 54 may include structural features, such as, but not limited to, ridge or grooves, to enable the flexible flowline 54 to flex.

Figure 5:
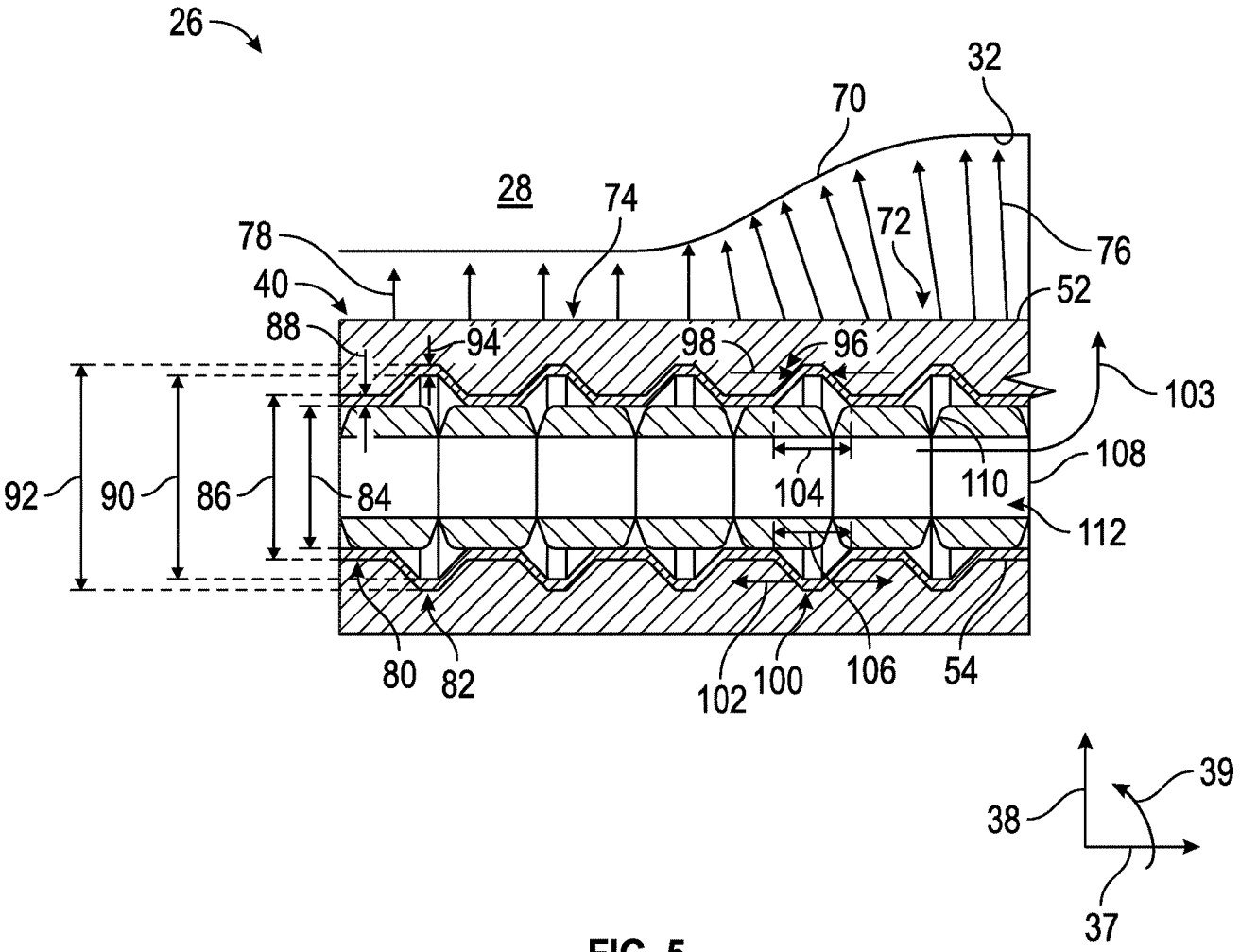
FIG. 5 is a cross-sectional view of a portion of a packer assembly according to an embodiment of the present disclosure.

FIG. 5 is cross-sectional view of a portion of the packer assembly 26 showing one flexible flowline 54. As shown in FIG. 5, the flexible flowline 54 is completely embedded within the outer layer 40. In certain embodiments, the flexible flowline 54 is partially embedded within the outer layer 40. As illustrated, the wellbore wall 32 may include one or more irregularities 70. In other words, the wellbore wall 32 may not be entirely smooth or straight. Thus, when the packer assembly 26 is in an uninflated or deflated state, a first portion 72 of the packer assembly 26 may be located further away from the wellbore wall 32 than a second portion 74. Accordingly, when the packer assembly 26 is inflated, the first portion 72 expands a greater distance radially 38 than the second portion 74, as represented by longer arrows 76 compared to shorter arrows 78. Use of the disclosed embodiments of the flexible flowline 54 enable the outer layer 40 to comply or conform with any irregularities 70 present in the wellbore wall, thereby improving the seal provided by the outer layer 40.

As shown in FIG. 5, certain embodiments of the flexible flowline 54 may include a plurality of first portions 80 and a plurality of second portions 82 coupled to one another in an alternating pattern. The portions 80 and 82 may be cylindrical or conical in particular embodiments. In some embodiments, the first and second portions may be coupled to one another in a variety of other repeating or irregular patterns. In addition, the axial 37 lengths of the first and second portions 80 and 82 may be varied to suit a particular application. The first portion 80 may be defined by a first inner diameter 84, a first outer diameter 86, and a first thickness 88. Similarly, the second portion 82 may be defined by a second inner diameter 90, a second outer diameter 92, and a second thickness 94. In the illustrated embodiment, the first and second portions 80 and 82 are different from one another. Specifically, the first inner diameter 84 is smaller than the second inner diameter 90, and the first outer diameter 86 is smaller than the second outer diameter 92. The differences in the inner and outer diameters and the alternating pattern of the first and second portions 80 and 82 results in a corrugated or accordion shape to the flexible flowline 54. Alternatively, the flexible flowline 54 may be described as having alternating grooves corresponding to the first portions 80 and alternating ridges corresponding to the second portions 82. These structural features (e.g., the first and second portions 80 and 82) enable the flexible flowline 54 to flex to assist the outer layer 40 to conform to irregularities 70 in the wellbore wall 32. In particular, an outer side 96 of the flexible flowline 54 may undergo compression, as indicated by inward-facing arrows 98, and an inner side 100 of the flexible flowline 54 may undergo tension, as indicated by outward-facing arrows 102, to enable the flexible flowline to flex or bend radially 38 toward the irregularity 70 as indicated by arrow 103. In other words, an outer length 104 of the outer side 96 may decrease and an inner length 106 of the inner side 100 may increase.

In the illustrated embodiment of FIG. 5, the inner thickness 88 is approximately the same as the outer thickness 94. However, in certain embodiments, the inner and outer thickness 88 and 94 may be different from one another. In further embodiments, the flexible flowline 54 may include a spiral ridge or spiral groove (e.g., helical ridge or helical groove). In other words, rather than the alternating series of first and second portions 80 and 82 shown in FIG. 5, certain embodiments may include a spiral first portion 80 and a spiral second portion 82.

In addition, the flexible flowline 54 may be made from a fairly rigid material, such as, but not limited to, a metal, an alloy, or a rigid plastic. Such relatively hard materials may be better able to resist large pressure differentials that may exert collapsing forces upon the flexible flowline 54. Although these materials may be relatively rigid, the structural features (e.g., the first and second portions 80 and 82) of the disclosed embodiments enable the flexible flowline 54 to flex or bend. In some embodiments, the flexible flowline 54 may be made from a less rigid material, such as, but not limited to, elastomeric materials, rubbers, or soft plastics. In these embodiments, the materials used to fabricate the flexible flowline 54 may provide enough flexibility without use of the structural features shown in FIG. 5. In other words, these embodiments may not include the first and second portions 80 and 82 with different diameters and/or thicknesses and instead the flexible flowline 54 may appear to be a tube or pipe with approximately constant diameter and/or thickness. In further embodiments, the flexible flowline 54 may be made from an elastomeric material, such as plastic or rubber, and be reinforced with a plurality of fibers at least partially embedded within the elastomeric material. The plurality of fibers may be include high-performance fibers, such as, but not limited to, carbon fibers, para-aramid synthetic fibers, or glass fibers, metallic fibers, or a combination of high-performance and metallic fibers. In such embodiments, the plurality of fibers may help improve the strength of the flexible flowline 54. Still further embodiments of the flexible flowline 54 may be made from elastomeric materials and also include the first and second portions 80 and 82 with different diameters and/or thicknesses to provide enhanced flexibility.

Certain embodiments may include a plurality of inserts 108. The inserts 108 may be cylindrical or conical depending on the shape of the flexible flowline 54. The inserts 108 may help provide additional structural integrity to the flexible flowline, which may be helpful when the flexible flow 54 is made from an elastomeric material or the flexible flowline 54 has a relatively small thickness 88 or 94. As shown in FIG. 5, a series of inserts 108 may be inserted into an interior of the flexible flowline 54 in an end-to-end arrangement. To assist with the flexing of the flexible flowline 54, certain embodiments of the inserts 108 may include beveled ends 110. In addition, the inserts 108 may have a smooth, circular interior bore 112, which may facilitate the transport of formation fluids containing debris, such as sand, rock, gravel, tar, asphaltenes, and so forth, which may tend to accumulate in interior ridges and grooves of the first and second portions 80 and 82 of the flexible flowline 54.

Figure 6:
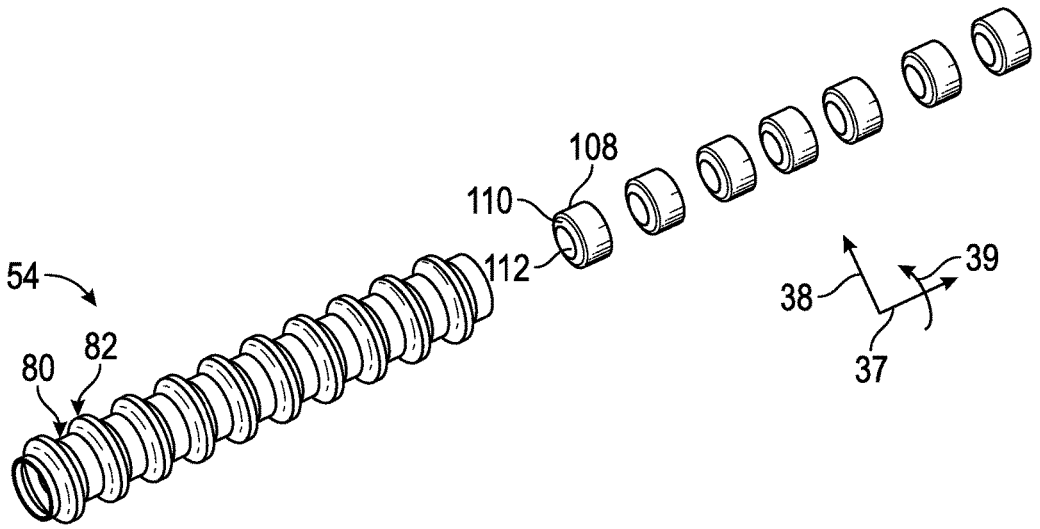
FIG. 6 is an exploded perspective view of a flowline of a packer assembly according to an embodiment of the present disclosure.

FIG. 6 is an exploded perspective view of the flexible flowline 54 with the plurality of inserts 108. During assembly of the packer assembly 26, the plurality of inserts 108 may be inserted into the flexible flowline 54 in an end-to-end manner. In addition, the perspective view of FIG. 6 shows the beveled ends 110 of the plurality of inserts 108. Again, as described above, the plurality of inserts 108 may be omitted in certain embodiments.

Figure 7:
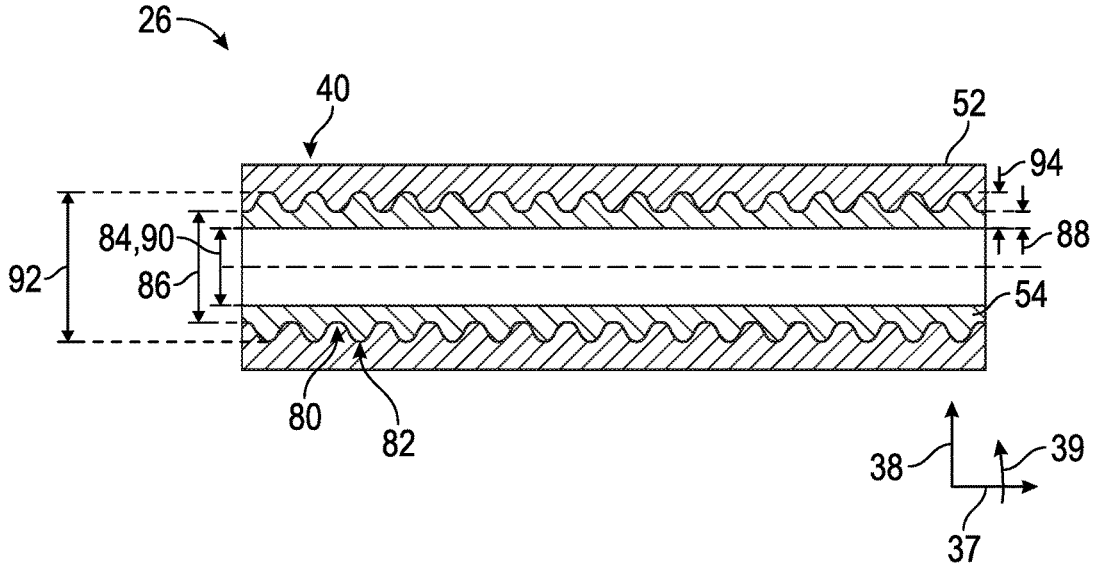
FIG. 7 is a cross-sectional view of a portion of a packer assembly according to an embodiment of the present disclosure.

FIG. 7 is a cross-sectional view of a portion of the packer assembly 26 illustrating a different embodiment of the flexible flowline 54. As with the embodiment shown in FIG. 5, the first and second portions 80 and 82 are different from one another. In particular, the first and second inner diameters 84 and 90 are approximately the same, the first outer diameter 86 is smaller than the second outer diameter 92, and the first thickness 88 is smaller than the second thickness 94. The differences in the outer diameters and thicknesses, and the alternating pattern of the first and second portions 80 and 82 results in a corrugated shape to the flexible flowline 54. Alternatively, the flexible flowline 54 may be described as having alternating grooves corresponding to the first portions 80 and alternating ridges corresponding to the second portions 82. These structural features (e.g., the first and second portions 80 and 82) enable the flexible flowline 54 to flex to assist the outer layer 40 to conform to irregularities 70 in the wellbore wall 32. In particular, the smaller first thickness 88 may provide flexibility to the flexible flowline 54 and the larger second thickness 94 may provide structural integrity, thereby enabling the flexible flowline 54 to better resist the effect of large pressure differentials while still conforming to irregularities 70.

In the illustrated embodiment of FIG. 7, the first and second inner diameters 84 and 90 are approximately the same while the first and second outer diameters 86 and 92 are different from one another. Thus, the interior of the flexible flowline 54 may have a smooth surface, which may facilitate the transport of formation fluids containing debris. However, in certain embodiments, the first and second inner diameters 84 and 90 may be different from one another while the first and second outer diameters 86 and 92 are approximately the same. Such an embodiment may be more susceptible to accumulation of debris, but still would still enable the flexible flowline 54 to conform to irregularities 70. In further embodiments, the flexible flowline 54 may include a spiral ridge or spiral groove (e.g., helical ridge or helical groove). In other words, rather than the alternating series of first and second portions 80 and 82 shown in FIG. 7, certain embodiments may include a spiral first portion 80 and a spiral second portion 82.

In addition, the flexible flowline 54 may be made from a fairly rigid material, such as, but not limited to, a metal, an alloy, or a rigid plastic. Such relatively hard materials may be better able to resist large pressure differentials that may exert collapsing forces upon the flexible flowline 54. Although these materials may be relatively rigid, the structural features (e.g., the first and second portions 80 and 82) of the disclosed embodiments enable the flexible flowline 54 to flex. In some embodiments, the flexible flowline 54 may be made from a less rigid material, such as, but not limited to, elastomeric materials, rubbers, or soft plastics. Such embodiments may also include the plurality of inserts 108 to provide additional structural integrity to the flexible flowline 54. In other respects, the embodiment shown in FIG. 7 is similar to that shown in FIGS. 5 and 6 and may include additional features such as those described above.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole packer assembly, comprising:

an outer skin;

an inner packer disposed within the outer skin such that inflation of the inner packer is configured to expand the outer skin; and a flexible flowline at least partially embedded within the outer skin, wherein the flexible flowline is configured to flex as the outer skin expands and a plurality of cylindrical inserts are configured to be disposed within the flexible flowline.

2. A downhole packer assembly, comprising:

an outer skin;

an inner packer disposed within the outer skin such that inflation of the inner packer is configured to expand the outer skin; and a flexible flowline at least partially embedded within the outer skin, wherein the flexible flowline is configured to flex as the outer skin expands;

wherein the flexible flowline comprises a plurality of first cylindrical portions and a plurality of second cylindrical portions, the first and second cylindrical portions are coupled to one another in an alternating pattern, each of the plurality of first cylindrical portions comprises a first inner diameter, each of the plurality of second cylindrical portions comprises a second inner diameter, and the first and second inner diameters are different from one another.

3. The downhole packer assembly of claim 2, wherein each of the plurality of first cylindrical portions comprises a first thickness, each of the plurality of second cylindrical portions comprises a second thickness, and the first and second thickness are the same.

4. The downhole packer assembly of claim 2, wherein each of the plurality of first cylindrical portions comprises a first thickness, each of the plurality of second cylindrical portions comprises a second thickness, and the first and second thickness are different from one another.

5. The downhole packer assembly of claim 1, wherein the flexible flowline comprises a plurality of first cylindrical portions and a plurality of second cylindrical portions, the first and second cylindrical portions are coupled to one another in an alternating pattern, each of the plurality of first cylindrical portions comprises a first outer diameter, each of the plurality of second cylindrical portions comprises a second outer diameter, and the first and second outer diameters are different from one another.

6. The downhole packer assembly of claim 5, wherein each of the plurality of first cylindrical portions comprises a first thickness, each of the plurality of second cylindrical portions comprises a second thickness, and the first and second thickness are different from one another.

7. A downhole packer assembly, comprising:

an outer skin;

an inner packer disposed within the outer skin such that inflation of the inner packer is configured to expand the outer skin; and a flexible flowline at least partially embedded within the outer skin, wherein the flexible flowline is configured to flex as the outer skin expands;

wherein the flexible flowline comprises a plurality of first cylindrical portions and a plurality of second cylindrical portions, the first and second cylindrical portions are coupled to one another in an alternating pattern, each of the plurality of first cylindrical portions comprises a first thickness, each of the plurality of second cylindrical portions comprises a second thickness, and the first and second thicknesses are different from one another.

8. The downhole packer assembly of claim 1, wherein an external surface of the flexible flowline comprises at least one of a spiral ridge, a spiral groove, a plurality of ridges, or a plurality of grooves.

9. The downhole packer assembly of claim 1, wherein each of the plurality of cylindrical inserts comprises beveled ends.

10. The downhole packer assembly of claim 1, wherein the flexible flowline is configured to flex at least partially in a radial direction of the downhole packer assembly as the outer skin expands.

11. The downhole packer assembly of claim 1, wherein the flexible flowline comprises at least one of a metal, an alloy, an elastomeric material, a rubber, or a plastic, or any combination thereof.

12. The downhole packer assembly of claim 1, wherein the downhole packer assembly is configured for conveyance within a wellbore by at least one of a wireline or a drillstring.

13. A sealing element for a downhole packer assembly, comprising:

a cylinder comprising an elastomeric material;

a flexible flowline at least partially embedded within the cylinder along an axial direction of the cylinder, wherein the flexible flowline is configured to flex at least partially in a radial direction of the sealing element as the cylinder expands; and a drain disposed in the cylinder;

wherein the flexible flowline comprises a plurality of first portions and a plurality of second portions, the first and second portions are coupled to one another in an alternating pattern, each of the plurality of first portions comprises a first outer diameter, a first inner diameter, and a first thickness, each of the plurality of second portions comprises a second outer diameter, a second inner diameter, and a second thickness, and at least one of the first and second outer diameters, the first and second inner diameters, or the first and second thicknesses are different from one another.

14. The sealing element of claim 13, comprising a plurality of inserts configured to be disposed within the flexible flowline.

* * * * *